US006616362B2

(12) United States Patent
Bouverie et al.

(10) Patent No.: US 6,616,362 B2
(45) Date of Patent: Sep. 9, 2003

(54) MODULAR PRINTER

(75) Inventors: William M. Bouverie, Windemere, FL (US); Mark Hitz, Lake Mary, FL (US); Chris Christensen, Orlando, FL (US)

(73) Assignee: Datamax Corporation, Orlando, FL (US)

( * ) Notice: Subject to any disclaimer, the term of this patent is extended or adjusted under 35 U.S.C. 154(b) by 0 days.

(21) Appl. No.: 09/965,533

(22) Filed: Sep. 26, 2001

(65) Prior Publication Data

US 2002/0067946 A1 Jun. 6, 2002

Related U.S. Application Data

(63) Continuation of application No. PCT/US00/08051, filed on Mar. 27, 2000.

(60) Provisional application No. 60/126,499, filed on Mar. 26, 1999.

(51) Int. Cl.[7] ..... B41J 29/02

(52) U.S. Cl. ..... 400/692; 400/691; 400/693; 400/693.1; 347/222

(58) Field of Search ..... 400/692, 691, 400/693, 693.1, 694; 347/222; 346/145

(56) References Cited

U.S. PATENT DOCUMENTS

| | | | | |
|---|---|---|---|---|
| 4,732,502 A | | 3/1988 | Yokoi | 400/693 |
| 4,776,714 A | * | 10/1988 | Sugiura et al. | 400/248 |
| 5,067,832 A | * | 11/1991 | Baur et al. | 400/66 |
| 5,103,259 A | | 4/1992 | Saitoh et al. | 355/206 |
| 5,195,837 A | * | 3/1993 | Steppe et al. | 400/719 |
| 5,320,437 A | | 6/1994 | Malke et al. | 400/605 |
| 5,344,248 A | * | 9/1994 | Schoon et al. | 400/693 |
| 5,507,583 A | | 4/1996 | Beaty et al. | 400/611 |
| 5,534,890 A | | 7/1996 | Krug et al. | 346/100 |
| 5,563,686 A | | 10/1996 | Beaufort et al. | 355/206 |
| 5,564,845 A | | 10/1996 | Yamaguchi et al. | 400/582 |
| 5,570,962 A | | 11/1996 | Suzuki et al. | 400/120.16 |
| 5,587,728 A | | 12/1996 | Edgar | 347/19 |
| 5,588,761 A | | 12/1996 | Seib | 400/579 |
| 5,619,240 A | | 4/1997 | Pong et al. | 347/103 |
| 5,707,162 A | | 1/1998 | Kasai et al. | 400/692 |
| 5,820,279 A | | 10/1998 | Lodwig et al. | 400/234 |
| 6,030,133 A | | 2/2000 | Endo | 400/82 |
| 6,231,253 B1 | * | 5/2001 | Henderson et al. | 400/618 |

FOREIGN PATENT DOCUMENTS

| | | |
|---|---|---|
| DE | 2802104 B1 | 1/1978 |
| EP | 0195949 A2 | 2/1986 |
| EP | 0798122 A2 | 1/1997 |

* cited by examiner

*Primary Examiner*—Andrew H. Hirshfeld
*Assistant Examiner*—Minh H. Chau
(74) *Attorney, Agent, or Firm*—Carter, DeLuca, Farrell & Schmidt, LLP

(57) ABSTRACT

A modular printer having a media take-up assembly module, a support block assembly module, a printhead assembly module, a stepper motor assembly module and a display assembly module is provided. A support body having a plurality of recesses formed on an internal wall of the modular printer is also provided. Each of the recesses is configured to receive and align one of the modular printer assemblies with the other modular printer assemblies. Each of the assemblies is configured as a module which can be easily accessed and quickly secured to or detached from the support body. The support body is adapted to receive assembly modules for both thermal ink printers and ribbon ink printers such that the modular printer can be easily converted from one to the other.

10 Claims, 8 Drawing Sheets

MODULAR PRINTER

This application is a continuation of International Application No. PCT/US00/08051 filed Mar. 27, 2000, which claims priority from U.S. provisional application Ser. No. 60/126,499 filed on Mar. 26, 1999, both of which are incorporated herein by reference in their entirety.

BACKGROUND

1. Technical Field

The present disclosure relates to printers in general and more particularly to a modular printer assembly having components configured as modules which can be easily and quickly removed and/or secured to the assembly to perform basic maintenance and/or convert the printer assembly from a thermal ink printer to a ribbon ink printer.

2. Background of Related Art

Thermal ink printers and ribbon ink printers are well known and widely used. These printers include a variety of complex components enclosed within a housing. Typically, the components are arranged in such a manner that it is difficult to access any one or all of the components to perform basic maintenance and repair. Thus, operational downtime to perform basic repairs and maintenance is prolonged and reliance on the availability of a service technician to maintain a printer operational is assured.

Conventional printers, as mentioned briefly above, include both thermal ink printers and ribbon ink printers. Thermal ink printers and ink ribbon printers include a majority of common components. Despite this fact, if an operator required or desired both a thermal ink printer and an ink ribbon printer, the operator would have to purchase two separate units at increased expense.

Accordingly, a need exists for a printer which is capable of operating as both a thermal ink printer and a ribbon ink printer. Moreover, a need exists for an improved, less complex printer having easily accessible internal components which facilitate speedy maintenance and repair by a service technician and/or the printer operator.

SUMMARY OF THE INVENTION

In accordance with the present disclosure, a modular printer having a support body is provided. The modular printer includes a media take-up assembly, a support block assembly, a printhead assembly, a media sensor assembly, a drive motor assembly, a cover assembly and a display assembly. Electrical circuitry in the form of circuit boards is provided to provide power where required. The support body defines an internal support wall having a plurality of recesses formed therein. Each recess is configured to receive one of the modular printer assemblies. Each assembly defines a separate module which can be independently secured to or removed from the support wall. The printing assemblies or modules are secured to one side of the support wall and the electric motor assembly and circuitry are secured to the opposite side of the support wall.

The modular printer disclosed herein allows for easy access to each of the printer components for repair and/or maintenance. Moreover, the modular configuration facilitates printer upgrading, i.e., conversion from a thermal ink printer to a ribbon ink printer.

BRIEF DESCRIPTION OF THE DRAWINGS

Various preferred embodiments are described herein with reference to the drawings wherein.

DETAILED DESCRIPTION OF PREFERRED EMBODIMENTS

Figure 1:
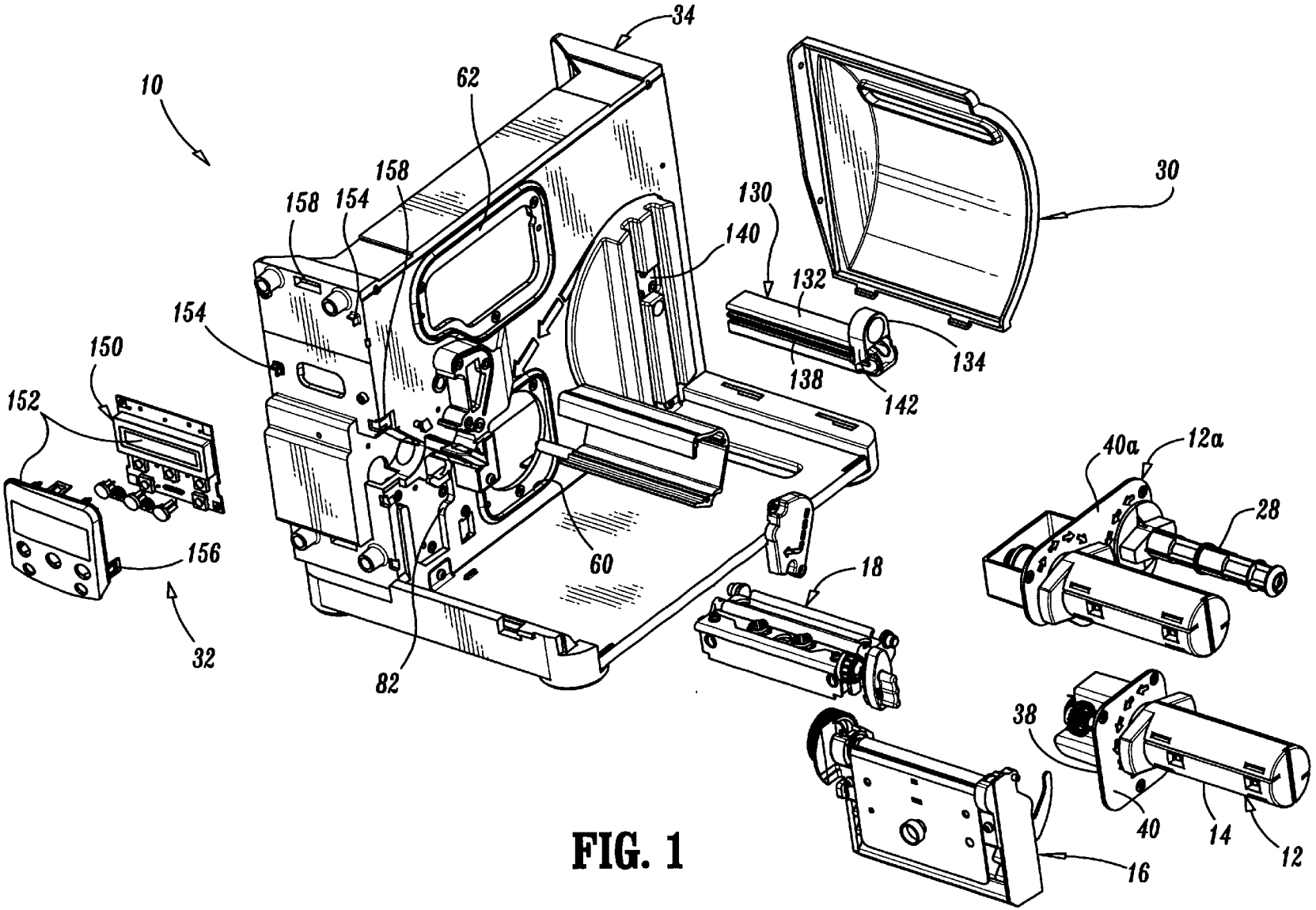
FIG. 1 is a perspective view with parts separated of one embodiment of the presently disclosed modular printer.

Preferred embodiments of the presently disclosed modular thermal printer will now be described in detail with reference to the drawings, in which like reference numerals designate identical or corresponding elements in each of the several views.

Figure 2:
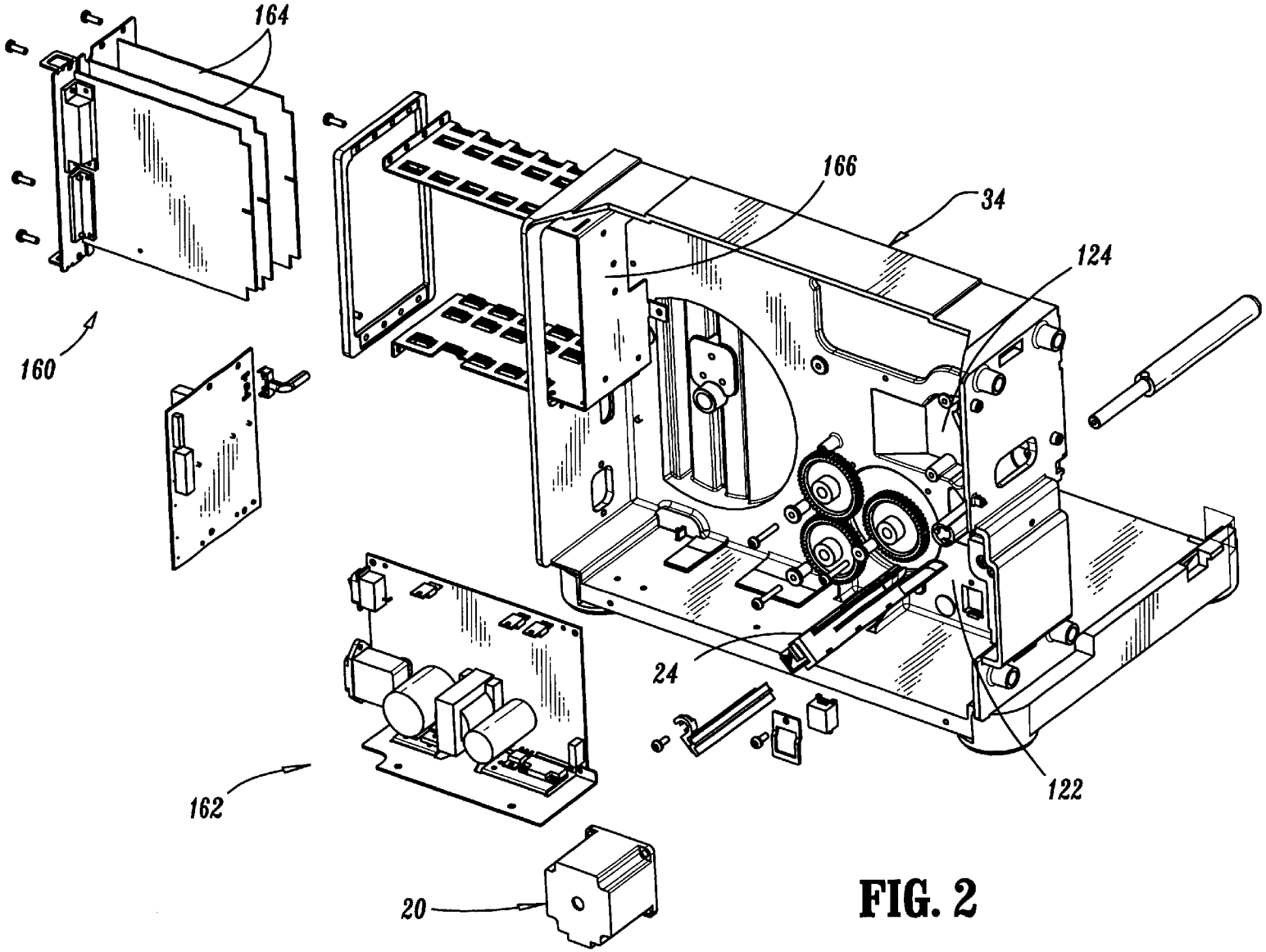
FIG. 2 is a perspective view with parts separated of the electrical and drive components of the modular printer shown in FIG. 1.

FIGS. 1 and 2 illustrate perspective views of the modular printer, with parts separated, shown generally as 10. More specifically, FIG. 1 illustrates the printing components of the modular printer and FIG. 2 illustrates the electrical and drive components of the modular printer.

Briefly, modular ink printer 10 includes a media take-up assembly 12 including a hub assembly 14 configured to support a media take-up roll (not shown), a support block assembly 16, a printhead assembly 18, a stepper motor assembly 20, a media sensor assembly 24, a cover assembly 30 and a display assembly 32. When printer 10 is operated as a ribbon ink printer, a ribbon spool take-up assembly 28 may also be provided in conjunction with the media take-up assembly. Each of the above-identified assemblies are removably supported on a support body 34 having a plurality of recesses, which will be discussed in further detail below. The support body defines an internal support wall of the modular printer and is configured to properly align each of the assemblies with respect to each of the other assemblies within the printer. Support body 34 is preferably formed from a heat conductive material, such as an aluminum support body, to facilitate the removal of heat from printer 10. However, other materials may also be used to form housing 34 including ceramics, plastics, sheet metal etc.

As discussed above, printer 10 has a display assembly 32. Display assembly 32 includes a module 150 having an LED display and a casing 152. Module 150 is positioned between diametrically opposed guide brackets 154 formed on support body 34. Opposite corners of module 150 are subsequently secured to support body 34 by screws. Casing 152 includes a plurality of flexible brackets 156 which can be snap fit to support body 34 over module 150. Support body 34 includes receiving structure 158 formed therein. Alternately, other known fastening devices may be used to secure module 150 and casing 152 to support body 34.

Referring again to FIG. 2, the electrical and drive components of the ink printer 10 are secured to the opposite side of support body 34 than are the printing components of the ink printer 10. As discussed above, stepper motor assembly 20 is secured to support body 34 on the side opposite the printing components. Electronic circuitry 160 and electric drive assembly 162 to operate ink printer 10 are secured to the support body 34 on the side opposite the printing components. Electronic circuitry 160 is in the form of circuit boards 164 which can be installed in printer 10 by sliding the circuit boards through an opening 166 formed in support body 34. The circuit boards can be chosen to suit the particular printing operation to be performed. For example, the circuitry 160 can be changed for different communications interfaces. Alternatively, software can be downloaded via a comport to control a particular printing application.

Figure 3:
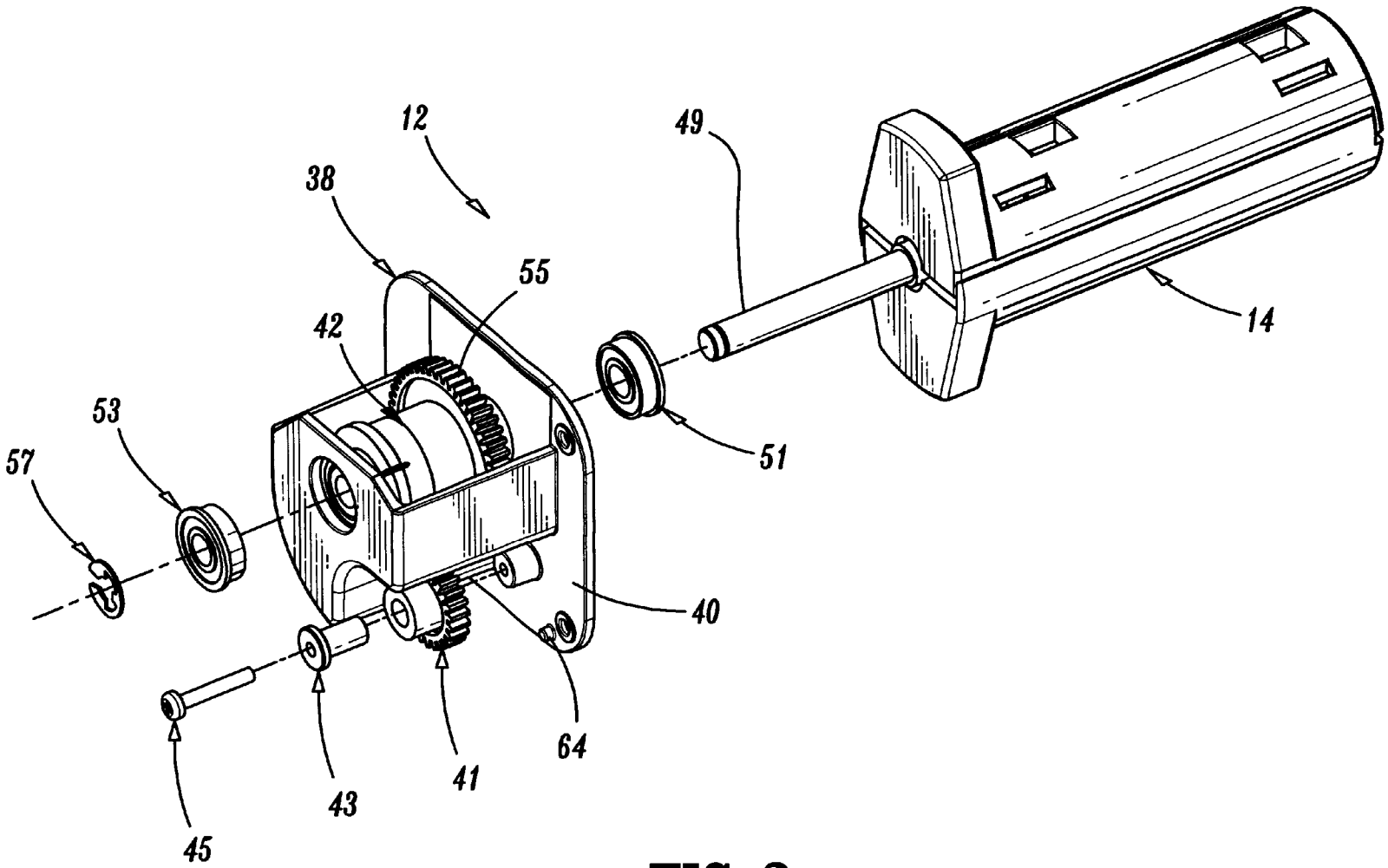
FIG. 3 is a perspective view with parts separated of the media take-up assembly of the modular printer shown in FIG. 1 when the printer is operated as a thermal ink printer.

Referring to FIG. 3, where printer 10 is operated as a thermal ink printer, media take-up assembly 12 includes hub assembly 14, a housing 38 having a base plate 40 and a media clutch assembly 42 supported within housing 38. Media take-up assembly 12 also includes a gear 41, a post idler 43, and a screw 45 for securing gear 41 and post idler 43 to housing 38. First end 49 is supported by bearings 51 and 53. Bearing 51 is supported in driven gear 55 and bearing 53 is supported by housing 38. A lock ring 57 secures bearings 51 and 53, gear 55 and media clutch assembly 42 to shaft 46.

Figure 4:
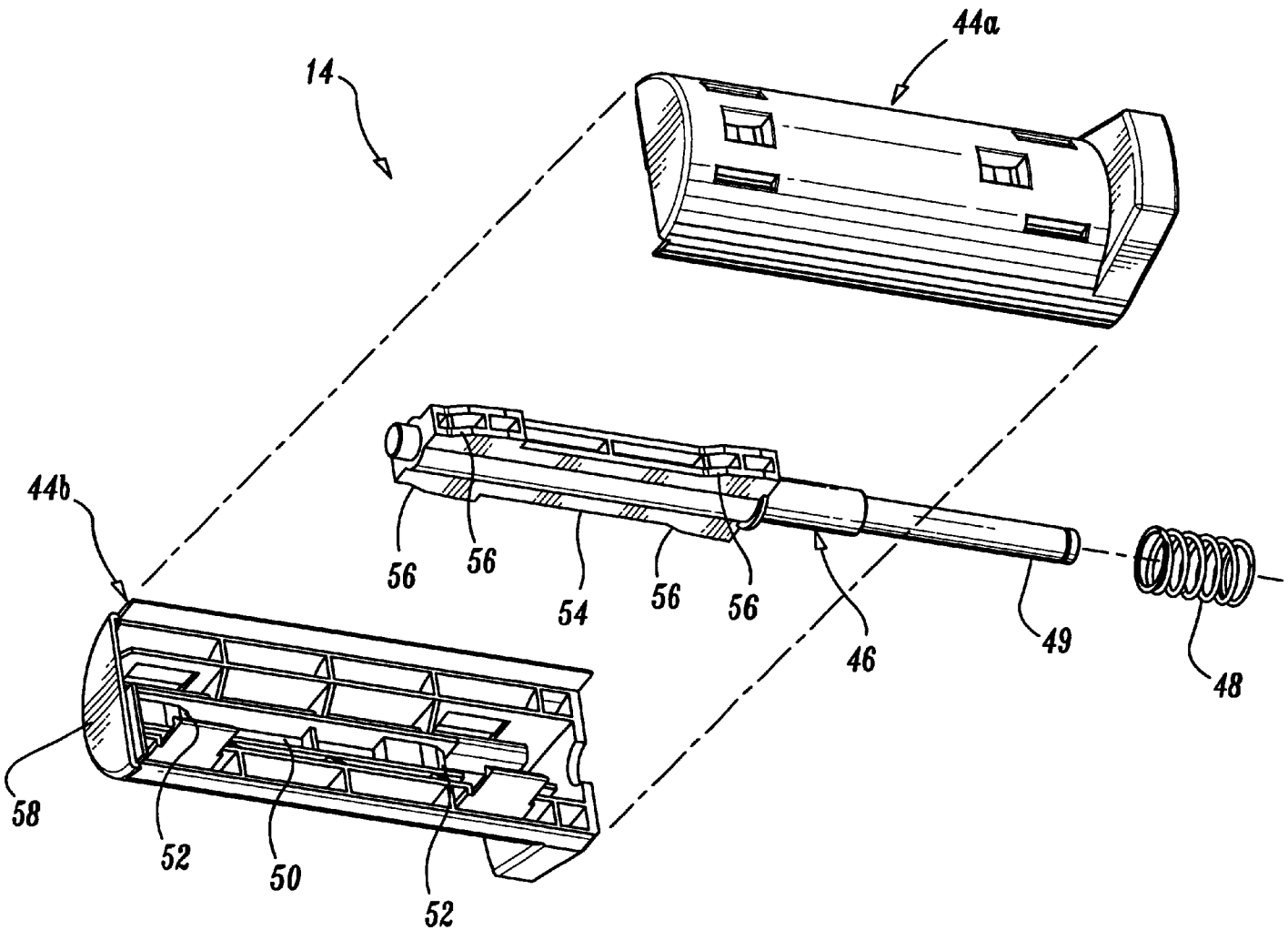
FIG. 4 is a perspective view with parts separated of the hub assembly of the media take-up assembly shown in FIG. 3.

Referring also to FIG. 4, hub assembly 14 includes a pair of molded housing half-sections 44*a* and 44*b* which define hub assembly housing 44, a hub shaft 46 and a biasing member which is preferably a coil spring 48. Hub shaft 46 includes a first end 49 having a reduced diameter which extends outwardly from hub assembly housing 44.

Hub assembly housing half-sections 44*a* and 44*b* define a channel 50 having a pair of cam surfaces 52 formed therein. An engagement member 54 is secured to or formed monolithically with hub shaft 46. Each side of engagement member 54 includes a pair of abutment surfaces 56. Alternately, abutment surfaces may only be provided on one side of engagement member 54.

In the assembled state, engagement member 54 of hub shaft 46 is slidably positioned within channel 50 with coil spring 48 urging hub shaft 46 towards the distal end 58 of housing 44. Abutment surfaces 56 are positioned adjacent but distal of respective cam surfaces 52. When it is desired to remove a media take-up roll from and/or position a media take-up roll onto hub assembly 14, housing half-sections 44*a* and 44*b* are pulled outward to force cam surfaces 52 into engagement with abutment surfaces 56. Because surfaces 52 and 56 are angled towards distal end 58, compression of the housing half-sections urges hub shaft 46 against the bias of spring 48 away from distal end 58 of housing 44 allowing housing half-sections 44*a* and 44*b* to move towards each other to facilitate installation or removal of a media take-up roll onto or from hub assembly 14.

Referring again to FIGS. 1 and 3, the entire media take-up assembly 12 including hub assembly 14, housing 38 and media clutch assembly 42 forms an integral unit or module. Support body 34 includes a plurality of reliefs formed on an internal wall of modular printer 10. One such relief 60 is configured to receive baseplate 40 of housing 38 and includes an alignment port 63 formed therein dimensioned to receive an alignment protrusion 64 formed on baseplate 40 to ensure proper positioning of media take-up assembly 12 on support body 34. Only three screws are required to secure the entire media take-up assembly 12 to support body 34, thus the entire assembly or module can be easily removed from or installed within printer 10.

Figure 5:
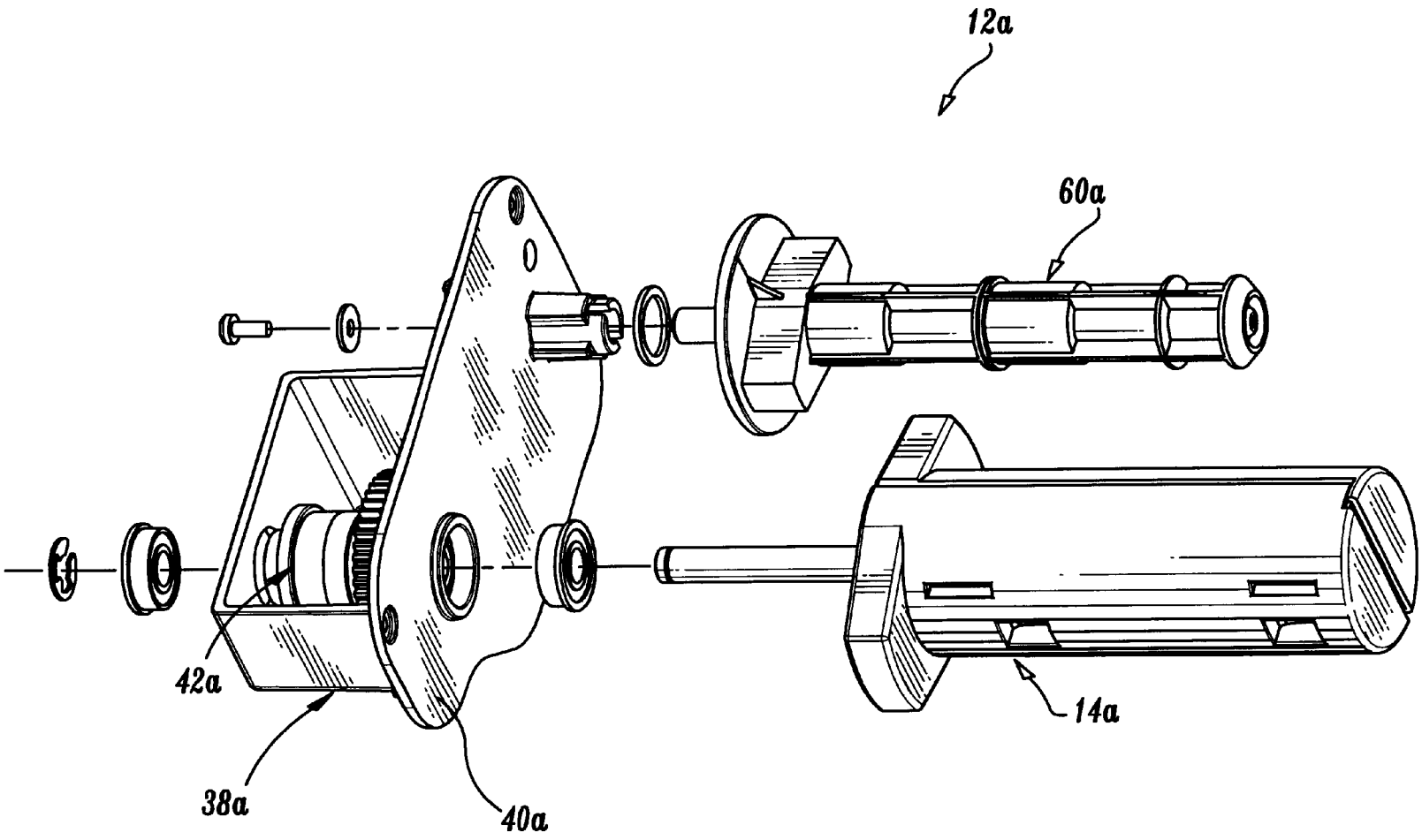
FIG. 5 is a perspective view of the media take-up assembly of the modular printer shown in FIG. 1 when the printer is operated as an ink ribbon printer.

Referring to FIG. 5, where printer 10 is operated as an ink ribbon printer, a second media take-up assembly 12*a* is provided which in addition to hub assembly 14*a*, housing 38*a* including baseplate 40*a*, and media clutch assembly 42*a*, includes a ribbon supply assembly 60*a*. Ribbon supply assembly 60*a* is also secured to baseplate 38*a* such that the media take-up assembly 14*a* forms an integral unit or module.

Referring again to FIGS. 1 and 5, a relief 62 configured to receive baseplate 40*a* is formed in support body 34. As discussed above with respect to relief 60, an alignment port (not shown) is formed in relief 62 to ensure proper positioning of media take-up assembly 12*a* within relief 62. Baseplate 40*a* can be secured to support body 34 using three screws, thus facilitating fast and easy removal and/or installation of media take-up assembly 12*a* within printer 10.

Since printer 10 can only be operated as either a thermal ink printer or an ink ribbon printer, only one of media take-up assemblies 12 or 12*a* will be secured to support body 34 at a time. However, the printer 10 can be easily and quickly converted from a thermal ink printer to a ribbon ink printer and vice-versa by substituting one media take-up assembly or module for the other. The relief configured to receive the baseplate of the media take-up assembly not in use should be covered by a blank (not shown), which is preferably constructed of the material used to form support body 34.

Figure 6:
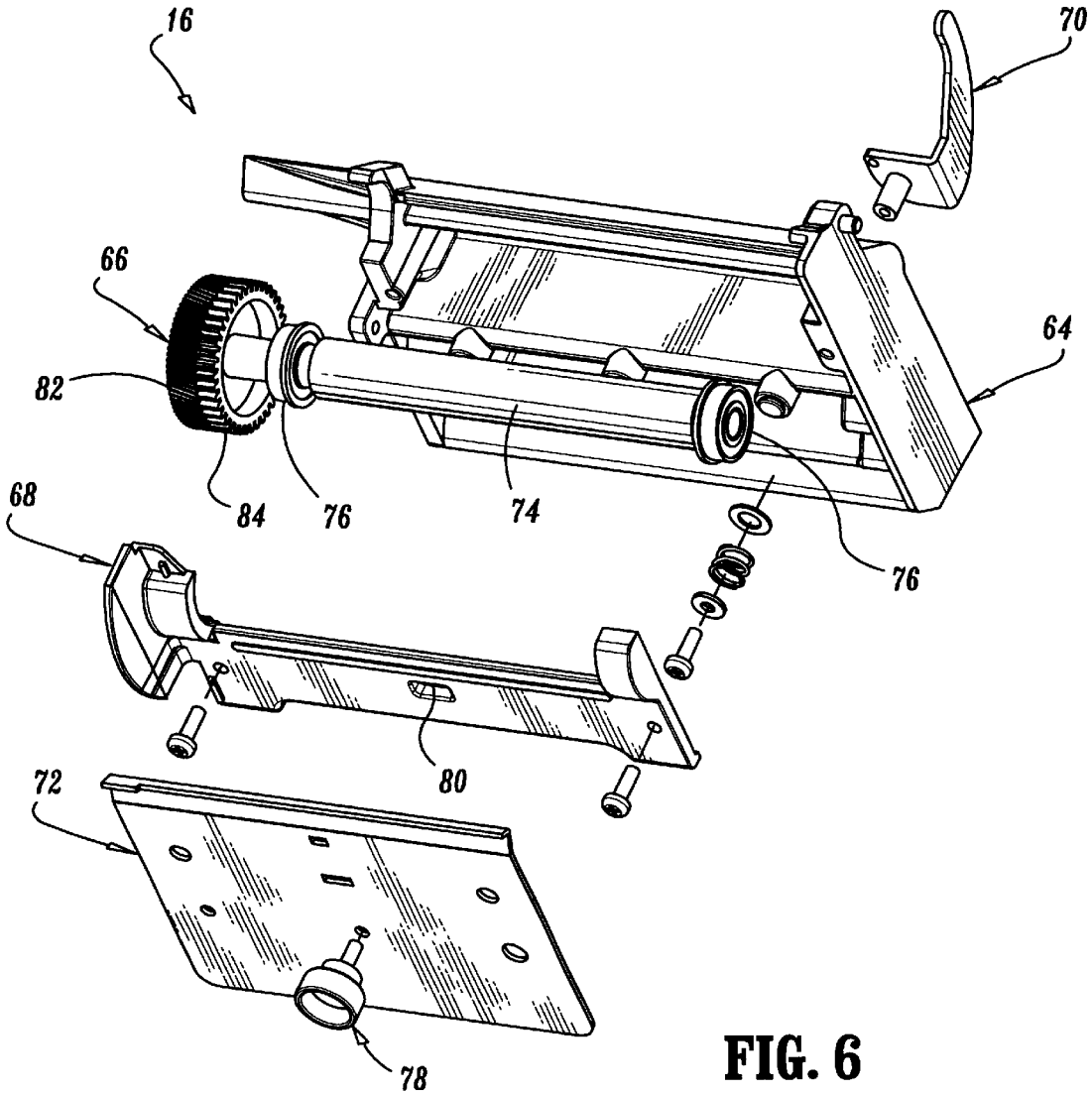
FIG. 6 is a perspective view with parts separated of the support block assembly of the modular printer shown in FIG. 1.

Referring to FIGS. 1 and 6, support block assembly 16 includes platen mounting block 64, a platen assembly 66, a retainer bracket 68, a media guide 70, and a tear bar 72. Platen assembly 66 includes platen 74 having a shaft (not shown) rotatably supported on mounting block 64. A flanged bearing 76 is secured to each end of the platen shaft. The bearings are positioned within recesses (not shown) formed in mounting block 64 to facilitate rotation of platen 74 relative to mounting block 64. A pair of driven gears 82 and 84 are secured to one end of the platen shaft and are independently engagable by a drive gear (which will be discussed below) to drive the platen 74. Retainer bracket 68 is secured to mounting block 64 via a pair of screws to retain bearings 76 within the recesses of mounting block 64. Tear bar 72 is secured to mounting block 64 by a screw 78 which extends through an opening 80 defined by retainer bracket 68.

It is noted that in printers found in the prior art, removal of a damaged platen is a difficult, time-consuming procedure. In contrast, all that is required to remove platen 74 from support block assembly 16 is to unscrew screw 78 from mounting block 64 to remove tear bar 72 from assembly 16, and to remove the two screws securing retainer bracket 68 to mounting block 64. Platen 68 can now be lifted from mounting block 64.

As discussed above with respect to media take-up assembly 12, the entire support block assembly 16 forms an integral unit or module which is secured within a relief 82 (FIG. 1) formed in support body 34. Support block assembly or module 16 can be easily and quickly removed and/or installed by removing or inserting a pair of screws (not shown) which extend between mounting block 64 and support body 34. Mounting block 64 also includes an alignment protrusion (not shown) configured to be received within an alignment port formed in support body 34 to ensure proper positioning of support block assembly or module 16 in relation to support body 34.

Figure 7:
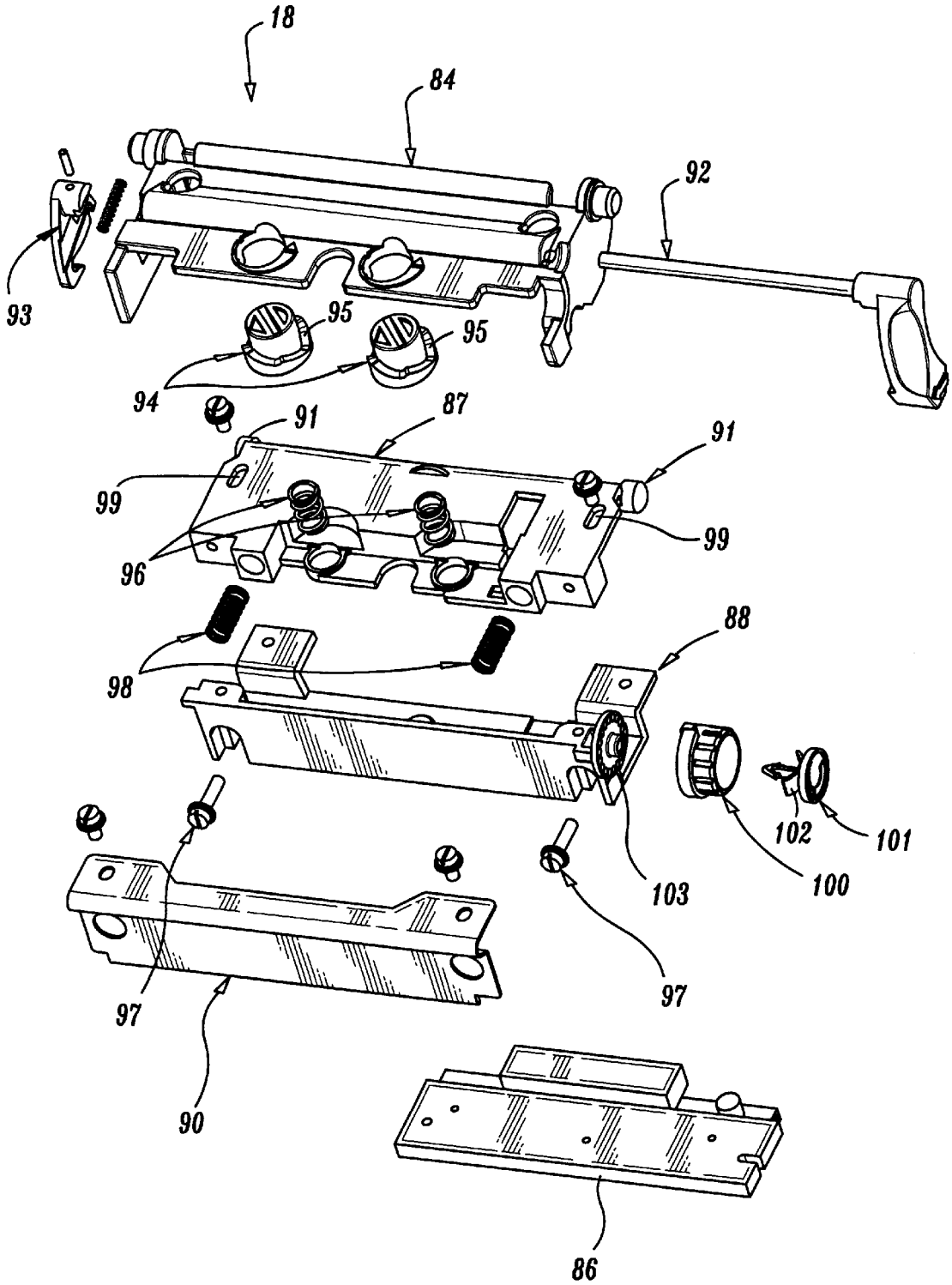
FIG. 7 is a perspective view with parts separated of the printhead assembly of the modular printer shown in FIG. 1.

Referring to FIG. 7, printhead assembly 18 includes a printhead mount 88, a printhead 86, a printhead adjustment bracket 87, and a ribbon shield 90. Printhead 86 includes a pair of pivot members 91 which are pivotably secured to printhead pivot 84. A latch assembly including latch members 92 and 93 is supported on printhead pivot 84 and is movable into a position to retain printhead 86 and printhead assembly 18 in fixed rotatable relation. A rotatable knob 94 having a cam surface 95 formed thereon is supported on each side of printhead 86. The cam surface 95 of each knob 94 is urged into engagement with printhead mount 84 by a spring 96. Both knobs 94 are selectively rotatable to urge printhead 86 away from printhead mount 84 to control printhead pressure of the printhead 86.

Printhead adjustment bracket 88 is secured to printhead adjustment bracket 87 by screws 97 which are positioned within slots 99 formed in printhead adjustment bracket 87. A pair of springs 98 are positioned between bracket 88 and printhead adjustment bracket 87 to urge bracket 88 away from printhead adjustment bracket 87. An adjustment knob 100 having a cam surface positioned to engage printhead 86 is rotatably secured to bracket 88 by a fastener 101 having a biasing member 102 formed therewith. Adjustment knob 100 includes a protrusion (not shown) which is urged into engagement with an annular array of detents 103 by fastener 101. Adjustment knob 100 is rotatable to selectively cam bracket 88 towards printhead 86 against the bias of springs 96. The adjustment knob protrusion and the annular array of detents 103 function to retain the bracket 88 and printhead 86 at fixed positions in relation to each other as determined by the rotational position of adjustment knob 100.

Referring again to FIGS. 1 and 7, the printhead assembly 18 forms an integral unit or module which is bolted to support body 34 to secure the assembly within the printer.

Figure 8:
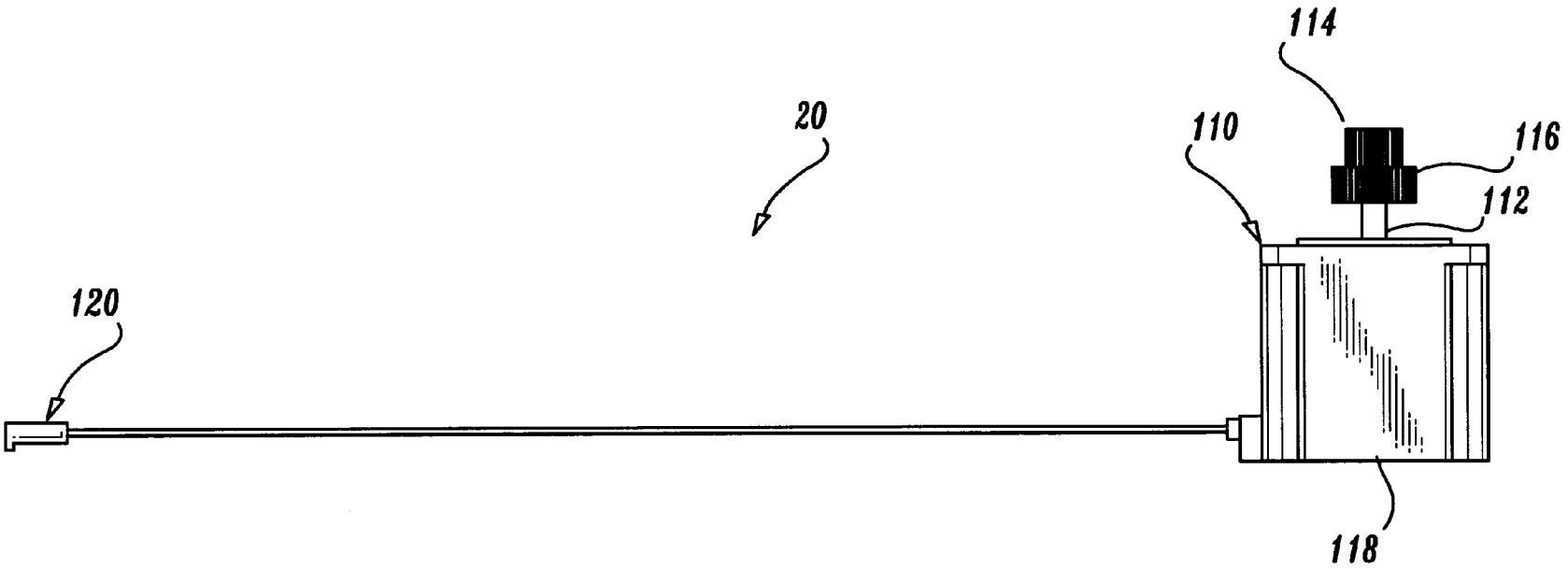
FIG. 8 is a top view of the steppr motor assembly of the modular printer shown in FIG. 1.

Referring to FIG. 8, stepper motor assembly 20 includes a stepper motor 110 having an output shaft 112 and a pair of gears 114 and 116 secured to output shaft 112. Stepper motor 110 is supported within a housing 118. A connector 120 having a contact pin (not shown) extends from housing 118 to facilitate connection of the stepper motor to a power source. Stepper motor assembly 20 forms an integral unit or module.

Referring also to FIG. 2, support body 34 includes first and second mounting locations 122 and 124 configured to receive motor assembly 20. Motor assembly 20 can be secured at either location to selectively position either one of gears 112 or 114 into meshing engagement with one of platen assembly gears 82 or 84 (See FIG. 6). This double gear multi-location mounting arrangement provides for a printer which is capable of changing speed simply by changing the location of the stepper motor on support body 34. Moreover, since only four screws need be removed, this process can be performed easily and quickly.

Referring again to FIG. 1, printer assembly 10 also includes a media supply hub assembly 130 which includes a hub 132 and an adjustable retaining member 134. Hub 132 includes an elongated slot 138 formed in each side thereof Adjustable retaining member 134 includes a body 140 having a pair of legs 142. Each leg 142 has a distal end portion (not shown) which is configured to be slidably received in elongated slot 138. When retaining member 134 is advanced to the distal end of slot 138, the slot configuration changes to permit the retaining member 134 to be pivoted from a position perpendicular to hub 132 to a position parallel thereto. In the parallel position, a media supply roll can be positioned on hub 132. After the media supply roll (not shown) is positioned on hub 132, retaining member 134 can be pivoted back to a position perpendicular to hub 132 and slid into contact with the media supply roll to retain the media supply roll on hub 132. The force on retaining member 134 by the media supply roll locks retaining member 134 in position on hub 132. Because retaining member 134 is slidable within slot 138 along the length of hub 132, multiple size media supply rolls can be securely held on hub 132 by retaining member 134. Preferably, hub 132 is constructed from cast aluminum and retaining member 134 is constructed from a reinforced plastic. Alternately, other materials of construction may be used for each of the parts including engineering metal, plastics, ceramics, etc. The media supply assembly 130 can be secured within relief 140 in support body 34 using screws. As described above, relief 140 ensures proper alignment of media supply assembly 130 in relation to the other components of the printer 10.

It will be understood that various modifications may be made to the embodiments disclosed herein. For example, all of the components need not be configured as modules, i.e., only one or some of the components may be configured in module form. Therefore, the above description should not be construed as limiting, but merely as exemplifications of preferred embodiments. Those skilled in the art will envision other modifications within the scope and spirit of the claims appended hereto.

What is claimed is:

1. A modular printer comprising a media take-up assembly module, a printhead assembly module, a motor assembly module, a support block assembly module including a platen assembly module and a support body, the support body having a plurality of recesses, each of the recesses being configured to receive one of the assembly modules of the modular printer at a position to align the assembly module with the other assembly modules of the modular printer in an operational configuration, each of the assembly modules being independently mountable to and detachable from the support body;

wherein the motor assembly module includes at least first and second gears, the support body defining first and second mounting locations, each mounting location being configured to mountably receive the motor assembly module such that when the motor assembly module is received in the first mounting location, the first gear is positioned in engagement with the support block assembly module, and when the motor assembly module is received in the second mounting location, the second gear is positioned in engagement with the support block assembly module.

2. A modular printer comprising:

a support body defining a support wall, the support wall having at least first and second recesses, the first recess being configured to receive a thermal ink printer media-take-up assembly module and the second recess being configured to receive a ribbon ink printer media take-up assembly module;

a printhead assembly module; and a media take-up assembly module, each module defining an integral unit which is independently mountable to and detachable from the support body;

wherein the modular printer can be selectively operated as a thermal ink printer or an ink ribbon printer by mounting a selected one of the thermal ink printer media take-up assembly module and the ribbon ink printer media take-up assembly module in one of the first and second recesses of the support wall.

3. A modular printer according to claim 2, wherein the support body is formed from an aluminum casting.

4. A modular printer comprising:

a media take-up assembly module;

a printhead assembly module;

a motor assembly module;

a support block assembly module; and a support body including a plurality of mounting locations, each of the mounting locations being configured to releasably support one of the modular printer assembly modules, the plurality of mounting locations including a first mounting location configured to receive a thermal ink printer media take-up assembly module and a second mounting location configured to receive a ribbon ink printer media take-up assembly module to facilitate operation of the modular printer as either a thermal ink printer or an ink ribbon printer:

wherein each of the modular printer modules defines an integral unit which is mountable to and detachable from the support body independently of each of the other modular printer modules.

5. A modular printer according to claim 4, wherein each of the plurality of mounting locations includes a recess configured to receive and align one of the modular printer assembly modules in relation to the other modular printer assembly modules.

6. A modular printer according to claim 5, wherein the support body is formed of cast aluminum.

7. A modular printer according to claim 4, further including electrical circuitry including at least one circuit board, the at least one circuit board being removably supported on the support body and replaceable to selectively control operation of the modular printer.

8. A modular printer according to claim 7, wherein the support body includes a support wall, the electrical circuitry and the motor assembly module being supported on one side of the support wall and the media take-up assembly module and the printhead assembly module being supported on the other side of the support wall.

9. A modular printer according to claim 4, further including a display assembly, the display assembly being removably secured to the support body.

10. A modular printer according to claim 4, wherein the support block assembly module includes a platen assembly.

* * * * *